United States Patent [19]

Beecher, II et al.

[11] 4,130,744

[45] Dec. 19, 1978

[54] CAM ACTUATED MULTIPLE CONTACT SPRING SWITCH

[75] Inventors: Robert L. Beecher, II; Harold J. Hershey; Robert S. Zieles, all of Indianapolis, Ind.

[73] Assignee: Bell Telephone Laboratories, Incorporated, Murray Hill, N.J.

[21] Appl. No.: 790,461

[22] Filed: Apr. 25, 1977

[51] Int. Cl.[2] ..... H01H 1/28; H01H 9/00

[52] U.S. Cl. ..... 200/1 A; 200/5 E; 200/153 LA; 200/159 A; 200/283; 200/314

[58] Field of Search ..... 200/1 A, 1 TK, 5 E, 200/5 EA, 5 EB, 6 B, 6 BA, 6 BB, 38 B, 38 BA, 38 C, 38 CA, 153 L, 153 LA, 159 A, 245, 246, 247, 283, 314, 340, 159 B; 197/102, 103

[56] References Cited

U.S. PATENT DOCUMENTS

| | | | |
|---|---|---|---|
| 1,161,192 | 11/1915 | Cook | 200/DIG. 46 |
| 2,748,204 | 5/1956 | Woods et al. | 200/245 X |
| 3,117,207 | 1/1964 | Baldasare | 200/314 |
| 3,126,466 | 3/1964 | Schwartz | 200/283 X |
| 3,281,544 | 10/1966 | Bailey et al. | 200/5 EA |
| 3,419,684 | 12/1968 | Lord et al. | 200/6 B X |
| 3,487,177 | 12/1969 | Shea | 200/5 EA |
| 3,487,178 | 12/1969 | Stout | 200/5 EA |
| 3,626,131 | 12/1971 | Stow et al. | 200/159 A |
| 3,671,686 | 6/1972 | Sadogierski | 200/5 EA |
| 3,679,988 | 7/1972 | Haydon | 200/38 B X |
| 3,715,545 | 2/1973 | Long | 200/159 A |
| 3,736,397 | 5/1973 | Pedersen | 200/340 X |
| 3,752,944 | 8/1973 | Cartier et al. | 200/38 B |
| 3,978,303 | 8/1976 | Miyata | 200/1 A X |
| 4,046,980 | 9/1977 | Rosebrock | 200/153 LA |

*Primary Examiner*—James R. Scott
*Attorney, Agent, or Firm*—Harry L. Newman

[57] ABSTRACT

A switch is disclosed in which manual adjustment of a contact spring pileup is avoided by closely controlling the interaction between (1) the contact springs, (2) a movable actuator including a plurality of cam surfaces, each of which is associated with an individual contact spring, and (3) a frame for supporting the actuator. This is achieved by molding a cam follower to one end portion and a mounting element to the other end portion of each contact spring. The mounting elements of the contact springs are positioned in engagement with one another and are secured to the frame. The mounting elements serve to orient the contact springs at a particular angle with respect to one another and accurately locate the contact springs and thereby the cam followers with respect to the cam surfaces of the actuator. The cam followers in combination with the associated cam surfaces serve to locate and provide a predetermined bias to the contact springs.

13 Claims, 11 Drawing Figures

CAM ACTUATED MULTIPLE CONTACT SPRING SWITCH

FIELD OF THE INVENTION

This invention relates to the field of switches and within that field to a cam actuated multiple contact spring switch.

BACKGROUND OF THE INVENTION

A significant problem in the mass production of a multiple contact spring switch is the difficulty of consistently obtaining, (1) the design spacing between contact springs when the switch is open, (2) the design timing of the closure of the contact springs relative to the movement of an associated actuator, and (3) the design contact force when the switch is closed.

Illustrative of the problem is the transfer switch disclosed in Baldasare Pat. No. 3,177,207. The switch comprises a movable cantilever contact spring that is situated between two stationary cantilever contact springs. The lower ends of the contact springs are interleaved with insulating separators and secured to a mounting strip. The upper ends of the stationary contact springs are free-standing and are deformed to extend at an angle to the lower ends. The upper end of the movable contact spring is tied to an actuator spring by an insulating spacer, and the actuator spring is itself biased against a cam surface on a pushbutton plunger. The pushbutton plunger is linearly displaceable between two positions, and the interaction between the actuator spring and the cam surface is such that in one position of the pushbutton plunger, the movable contact spring is in engagement with a first of the stationary contact springs and spaced from the second stationary contact spring. In the other position of the pushbutton plunger, the location of the movable contact spring is reversed.

The upper and lower ends of the pushbutton plunger are respectively slidably supported on a bearing bar and a bottom strip, which are discrete elements that are joined to one another by other discrete elements. In addition, the mounting strip to which the contact springs are secured is in turn secured to the bottom strip. Thus it is seen that the location of the movable contact spring with respect to the stationary contact springs varies from switch to switch in accordance with tolerance variations in the pushbutton plunger, the bearing bar, the bottom strip, the mounting strip, the actuator spring, the plurality of insulating separators, the insulating spacer, and the movable and stationary contact springs. Therefore, if the switch is manufactured on a mass production basis, it is exceedingly difficult to obtain consistency of spacing, contact force, and timing, and manual adjustment of the contact springs is necessary after they are assembled.

An improvement over this arrangement is disclosed in Stow et al. U.S. Pat. No. 3,626,131. Stow discloses a pushbutton switch comprising a hollow case having a collar within which a pushbutton plunger is slidably displaceable. The case is snap-mounted to a base having a pair of cantilever contact springs mounted thereon and the free ends of the contact springs are respectively biased against individual cam surfaces on the plunger. The cam surfaces are arranged such that the contact springs are normally separated, but when the plunger is depressed, one of the springs is deflected outwardly into engagement with the other contact spring. Thus the switch has fewer elements than that of Baldasare, resulting in less tolerance buildup, and the position of the contact springs with respect to one another is determined by the cam surfaces on the plunger.

However, both contact springs have a convoluted configuration. A first of the contact springs comprises a bent bearing end for engaging the cam surface, an inclined stem section, a horizontal mounting section, and a vertical terminal section. The other contact spring comprises a horizontal contact section that overlies the stem section, a horizontal mounting section, and a vertical terminal section. The convoluted shapes of the contact springs require a number of forming operations and each such operation introduces another tolerance variation from spring to spring. As a result, it is likely that manual adjustment of the contact spring is necessary if there is to be a consistency between switches in the contact force and in the timing of the closure responsive to the actuation of the plunger.

SUMMARY OF THE INVENTION

In the switch of the present invention, manual adjustment of the contact springs is avoided by closely controlling the interaction between, (1) the contact springs, (2) a movable actuator including an individual cam surface associated with each contact spring, and (3) a frame for supporting both the actuator and the contact springs. This close control is achieved by using contact springs that have a rectilinear form and have a cam follower molded to one end portion and a mounting element molded to the other end portion thereof. This close control is further achieved by a frame comprising a rigid metal channel having locating details molded to the upper and lower extremities thereof.

The actuator is displaceably supported on the locating details, while the mounting elements of the contact springs are stacked on the lower locating details of the frame and keyed to one another and to the lower locating details. The frame provides a very accurate support for the actuator and the contact springs, and the mounting elements of the contact springs serve to orient the contact springs at a particular angle with respect to one another and accurately locate the contact springs and thereby the cam followers with respect to the cam surfaces of the actuator. As a result, the spacing between the contact springs, the contact force, and the timing of the switching are all accurately controlled.

DETAILED DESCRIPTION

Figure 1:
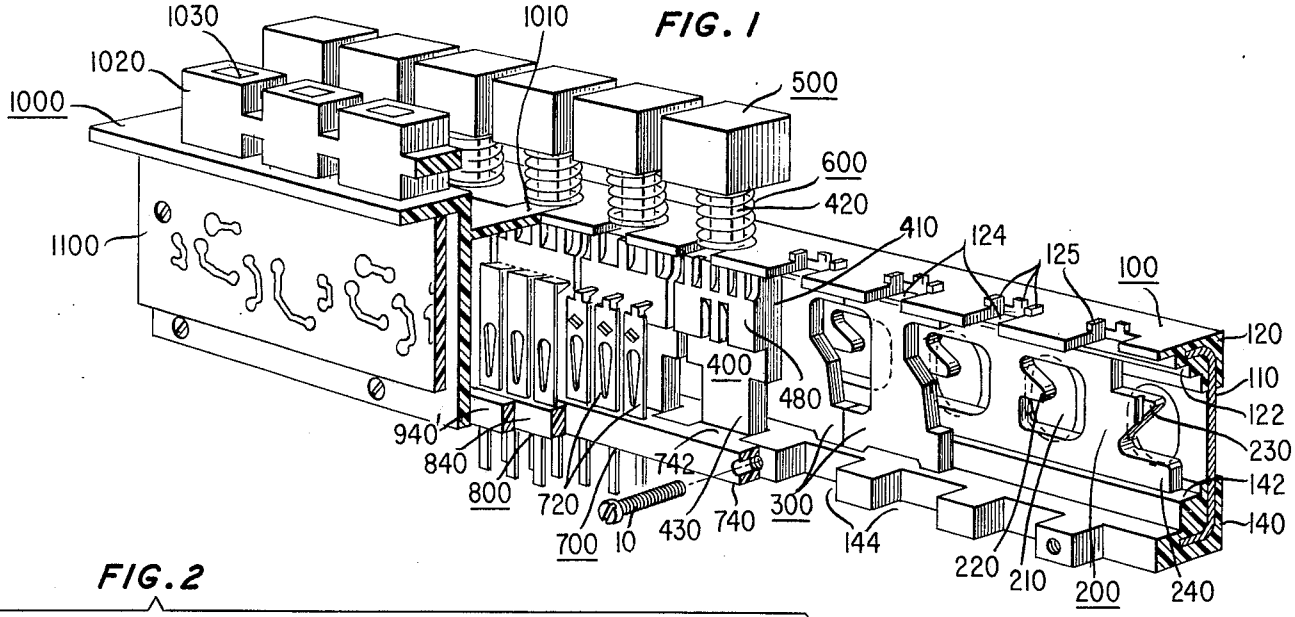
FIG. 1 is a front perspective view of a multibutton key incorporating an exemplary embodiment of the switch of the present invention, parts of the key being broken away to expose the components of the key.

Referring to FIG. 1 of the drawing, a multi-pushbutton key incorporating a switch exemplary of the present invention includes a frame 100 comprising a U-shaped rigid metal channel 110 having an upper locating element 120 and a lower locating element 140 respectively molded to the extremities thereof. The locating elements 120 and 140 extend generally parallel to one another and respectively include opposed stepped surfaces 122 and 142 that define individual slots for accommodating a latch bar 200 and a plurality of lockouts 300. In addition, the locating elements 120 and 140 respectively include a plurality of uniformly spaced notches 124 and 144 that are aligned with one another.

As indicated in FIG 1, the latch bar 200 comprises a planar ribbon-like member having a plurality of uniformly spaced and identically shaped openings 210 therein. The center-to-center spacing of the openings 210 is the same as that of the aligned pairs of notches 124 and 144 in the frame 100, and the surface on the left side of each opening includes a nose portion 220, the upper surface of which is inclined and the lower surface of which is generally horizontal. However, the shaped opening 210 adjacent to the right end of the latch bar 200 is absent and an inverted nose portion 230, comprising a horizontal upper surface and an inclined lower surface, is provided in place of the nose portion 220.

The latch bar 200 is slidably displaceable along the lower surface of the slot in the frame 100 in which it is accommodated, and a spring (not shown) biases the latch bar toward the right whereby a stop on the latch bar is normally in engagement with an abutment (not shown) on the frame. In this position of the latch bar 200, each nose portion 220 and inverted nose portion 230 is positioned adjacent to an aligned pair of notches 124 and 144 in the frame 100.

The lockouts 300 are basically rectangular planar members having a height that is slightly less than that of the slot within which they are accommodated and having a width that is approximately the same as the center-to-center spacing of the aligned pairs of notches 124 and 144.

Figure 2:
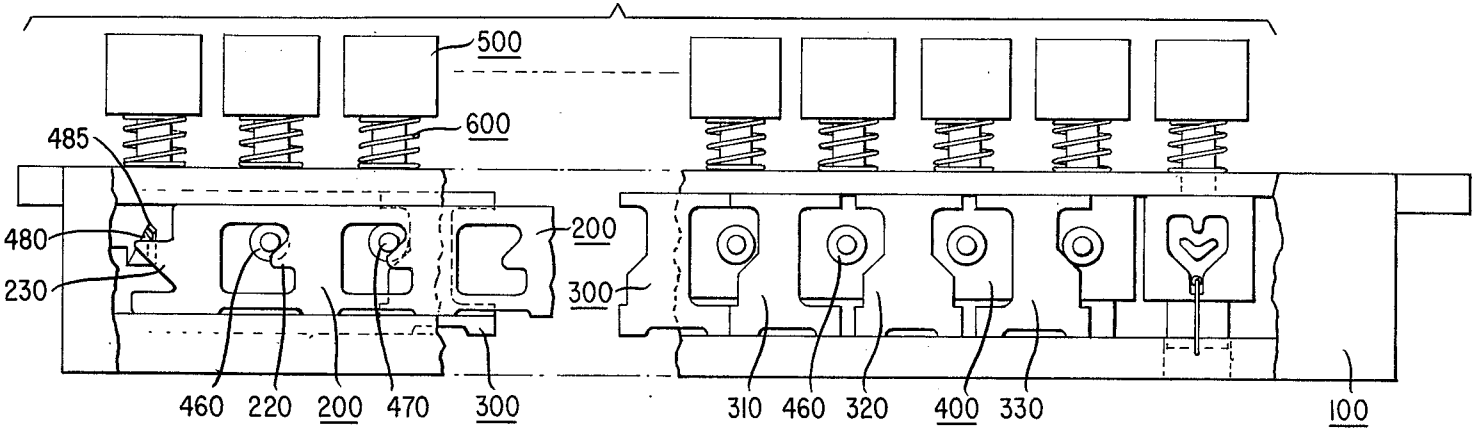
FIG. 2 is a rear view of the key with parts also broken away.

As shown in FIG. 2, the lockouts 300 have three different shapes indicated as 310, 320 and 330, but they are of two basic types, full lockouts and half lockouts. The lockout 320 is a full lockout in that both of its sides are relieved between the upper and lower extremities thereof to provide a recess adjacent to its upper end that leads into a downwardly and outwardly extending shoulder adjacent to its lower end. The lockouts 310 and 330 are, on the other hand, half lockouts in that just one of their sides has the foregoing configuration, while the other of their sides has a recess that is continuous between the upper and lower extremities of the side. The lockouts 310 and 330 are identical and are assembled opposite and into the identical frame 100.

Referring again to FIG. 1, the latch bar 200 and lockouts 300 interact with a plurality of reciprocally displaceable planar actuators 400 respectively associated with the aligned pairs of notches 124 and 144 in the frame 100. Each actuator 400 includes a wide body portion 410 having a narrow upper guide portion 420 upstanding therefrom a narrow lower guide portion 430 depending therefrom. The body portion 410 is positioned between the locating elements 120 and 140, while the upper and lower guide portions 420 and 440 respectively extend within the associated pair of notches 124 and 144. The upper and lower guide portions 420 and 440 are of a slightly lesser width than the notches with which they are associated, and the surfaces of the notches serve as bearings for directing the movement of the actuators 400 along a rectilinear path. The movement of each actuator 400 is limited by the engagement of its body portion 410 with the upper and lower locating elements 120 and 140.

Figure 3:
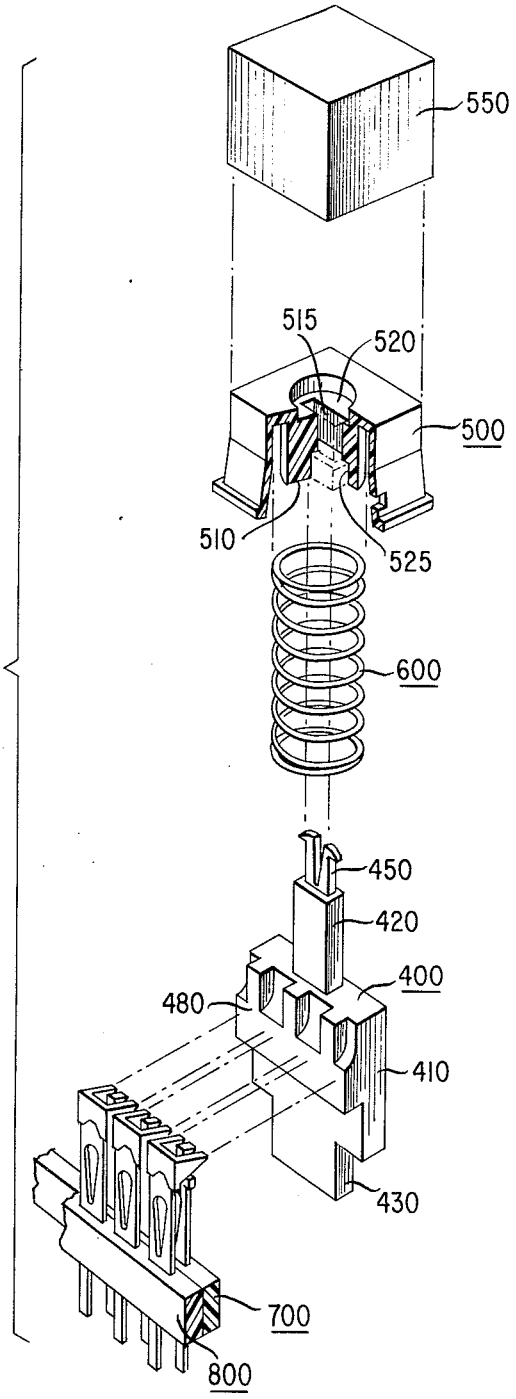
FIG. 3 is an exploded perspective view of a pushbutton actuator of the key and an associated pair of contact spring assemblies.

As shown in FIG. 3, a catch portion 450 extends from the end of the upper guide portion 420 and serves to secure a rectangular button 500 to the actuator 400. The catch portion 450 comprises a pair of inverted L-shaped flexible elements having upwardly extending legs terminated by laterally and oppositely extending feet. The button 500 with which the catch portion 450 interacts comprises an inverted cup-shaped member having a depending cylindrical portion 510 in the center thereof through which an opening 515 extends. The catch portion 450 is inserted into the lower end of the opening 515, and the opening is of a width to deflect the flexible elements toward one another. In addition, the height of the opening 515 is such that the laterally extending feet move out of the upper end of the opening into a recess 520 in the top of the button at the same time that the upper guide portion 420 seats within a conforming recess 525 in the bottom of the cylindrical portion 515. The flexible elements 450 thereupon return to their normal spaced position, whereby the feet move over the bottom surface of the recess 520 and secure the button 500 to the actuator 400. A transparent cap 550 that telescopes over and snap mounts to the button 500 serves to retain a designation label (not shown) in place on the button.

Referring to FIGS. 1 and 3, a helical compression spring 600 disposed about the upper guide portion 420 biases the actuator 400 toward its upper position. The spring 600 is captured between the button 500 and the upper locating element 120 of the frame 100, and the upper end of the spring extends within the button and encompasses the depending cylindrical portion 510 thereof. The lower end of the spring 600, on the other hand, embraces a plurality of bosses 125 protruding from the top surface of the upper locating element 120, an individual boss being positioned on each side of the associated notch 124. These components cooperate to maintain the spring 600 in alignment with the linear path of displacement of the actuator 400.

The plurality of actuators 400 serve to retain the latch bar 200 and lockouts 300 within their respective slots in the frame 100, and as shown in FIG. 2, the adjacent side of the body portions 410 of most of the actuators includes a disk 460 having a coaxial pin 470 extending therefrom. Each disk 460 extends into the slot in the frame 100 within which the lockouts 300 are accommodated, and the dimensions of the disk and of the lockouts are such that the following relationships exist.

When an actuator 400 is in its upward position, the disk 460 thereon is situated within the recess of an adjacent lockout 300. As the actuator 400 is depressed, the shoulder on an associated lockout 300 may be in the path of the disk 460 in which case that lockout and all other abutting lockouts are deflected laterally away from the disk, a distance that places the shoulder of the other lockouts in the paths of the disks on their associated actuators. If a pair of actuators 400 straddling a full lockout 320 are simultaneously depressed, the disks 460 on the actuators engage the shoulders of the lockout and the actuators are unable to move to their downward position. However, if a pair of actuators 400 straddling a half lockout 310 or 330 are simultaneously depressed, the half lockout may be deflected laterally by the engagement of its shoulder by the associated disk 460, but both actuators are able to move to their downward position.

As a result of these relationships, with lockouts arranged in the manner shown in FIG. 2, all of the actuators 400 straddling the half lockouts 310 may be moved to their lower position in any combination simultaneously. Similarly, the actuators 400 straddling the half lockout 330 may be moved to their lower position simultaneously. However, because of the full lockout 320, none of the actuators 400 straddling the half lockouts 310 may be moved to their lower position at the same time as the actuators straddling the half lockouts 330.

The pin 470 extending from each disk 460 extends into the adjacent opening 210 in the latch bar 200, and when the latch bar is in its normal position and the actuator 400 is in its upward position, the associated pin overlies the nose portion 220 at the side of the opening. Thus when the plunger 400 is depressed, the pin 470 engages the inclined surface of the nose portion 220 and deflects the latch bar 200 toward the right. The pin 470 continues to deflect the latch bar 200 to the right until the pin moves past the end of the nose portion 220. When this occurs, the biasing spring returns the latch bar 200 to its normal position, and the horizontal surface of the nose portion 220 is moved over the pin 470, latching the actuator 400 in a downward position.

When another actuator 400 having a pin 470 is subsequently depressed, the latch bar 200 is again deflected to the right, and when the pin of the second actuator reaches the end of the inclined surface of the associated nose portion 220, the latch bar is deflected to a position wherein the pin on the first actuator is no longer beneath the horizontal surface of its associated nose portion. The spring 600 associated with the first actuator 400 thereupon moves the actuator to its upward position.

The actuator 400 on the far left, as viewed in FIG. 2, has a U-shaped spring member 480 instead of the disk 460 and pin 470. A first leg of the spring member 480 is secured to this actuator 400 while the second leg extends in a generally vertical plane spaced from the actuator, the free end of the second leg being deflectable in a generally horizontal plane. In addition, the second leg terminates in an inclined triangular flange 485 that overlies the nose portion 230 of the latch bar 200 when the latch bar is in its normal position and this actuator 400 is in its upward position.

When this actuator 400 is depressed, the flange 485 on the spring member 480 engages the horizontal surface of the nose portion 230 and is deflected behind the nose portion, moving the second leg toward the actuator. As this plunger 400 continues to move downward, the flange remains behind the nose portion 230 until the actuator is depressed far enough to move the flange below the inclined surface of the nose portion. When this occurs, the second leg moves out from this actuator 400 and the flange 485 underlies the inclined surface of the nose portion 230.

Thereafter when this actuator 400 is permitted to move upward under the bias of its associated spring 600, the flange 485 on the spring member 480 engages the inclined surface of the nose portion 230 and deflects the latch bar 200 to the right. It continues to deflect the latch bar 200 to the right until it reaches the end of the inclined surface, at which point the latch bar has moved far enough to the right to move the horizontal surface of the nose portion 220 out of the path of the pin 470 on a previously depressed actuator 400. The previously depressed actuator 400 then moves to its upward position under the bias of its associated spring 600.

From the foregoing it is seen that when any of the actuators 400 having a pin 470 is moved to its downward position, it is latched in that position, and any previously latched actuator is released. When the actuator 400 on the far left is moved to its downward position, it is not latched in that position, and as it returns to its upward position, it releases any previously latched actuator.

Turning again to FIG. 1, the side of each actuator 400 facing away from the latch bar 200 includes a cam surface 480 on the body portion 410 that interacts with a pair of contact spring assemblies 700 and 800. The contact spring assembly 700 comprises a multiplicity of identical rectilinear contact springs 720 having a common mounting element 740 molded thereon in the proximity of the lower end thereof. The mounting element 740 serves to locate the contact springs 720 side by side and equally spaced from one another in a common plane. In addition, the mounting element 740 serves to locate the contact springs 720 with respect to the actuators 400, three side by side contact springs being associated with each actuator.

The mounting element 740 has a plurality of rectangular protrusions 742, one of which is shown, that are equal in number to and respectively accommodated within the notches 144 in the locating element 140 of the frame 100. The protrusions 742 locate the contact spring 720 laterally with respect to the direction of movement of the actuators 400 and also provide bearing surfaces for the lower quide portions 430 of the actuators. Other protrusions (not shown) on the mounting element 740 interact with cavities (not shown) in the lower locating elements 140 to locate the contact springs 720 parallel to the direction of movement of the actuators 400. Finally, the portions of the mounting element 740 between the protrusions 744 are placed in direct engagement with and fastened to the portions of the locating element 140 between the notches 144. The mounting element 740 thereby orients the contact springs 720 at a particular angle with respect to the actuators 400. As shown most clearly in FIGS. 6–10, the mounting element 740 is molded on the contact springs 720 so that when it is secured to the locating element 140, the contact springs lie in a plane that extends obliquely with respect to the path of movement of the actuators 400, the upper ends of the contact springs extending away from the actuators.

Figure 4:
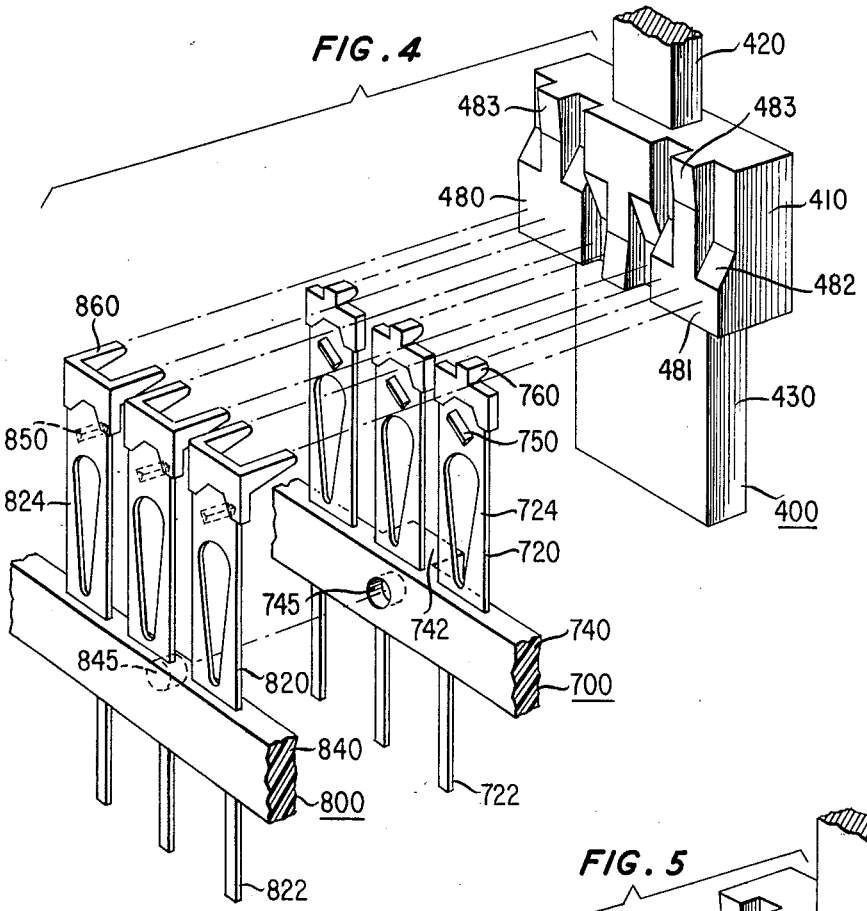
FIG. 4 is an exploded perspective view on a larger scale than FIG. 3 illustrating the relationship between cam followers on the contact springs and cam surfaces on the actuator.

Referring now to FIG. 4, the portion of each contact spring 720 depending from the mounting element 740 comprises an offset terminal 722, while a cantilever portion 724 extends upwardly from the mounting element. A precious metal contact 750 is bonded to each cantilever portion 724 on the surface facing away from the associated actuator 400, while an identical cam follower 760 is molded to the free end of each cantilever portion. Each cam follower 760 has a wedge-shaped profile and extends toward the associated actuator 400. In addition, each cam follower 760 is centered between the sides of the cantilever portion 724 and occupies less than a third of its width.

The contact spring assembly 800 is similar to the contact spring assembly 700 in that it includes a multiplicity of contact springs 820 having a common mounting element 840 molded thereon in the proximity of the lower end thereof. The mounting element 840 locates the contact springs 820 side by side in a common plane with the same spacing as the contact springs 720. Furthermore, the mounting element 840 is positioned in direct engagement with the mounting element 740 and has a plurality of pins 845, one of which is shown, that are respectively accommodated in conforming cavities 745, one of which is shown, in the mounting element 740 to accurately locate the mounting element 840 with respect to the mounting element 740.

The contact springs 820 are thereby accurately located both laterally, vertically and at a particular angle with respect to the actuators 400 and the contact springs 720. The mounting element 840 locates the contact springs 820 in alignment with the contact springs 720 and, as shown in FIGS. 6–10, in a plane that extends generally parallel to the path of movement of the actuators 400. This orientation of the contact springs 820 places the upper end of each in close proximity with the upper ends of an individual contact spring 720.

Each contact spring 820 includes a depending terminal 822 that is offset opposite to the terminals 722 of the contact springs 720. In addition, each contact spring 820 includes an upstanding cantilever portion 824 having a precious metal contact 850 bonded thereto on the surface facing and in a position to engage the contact 750 on the cantilever portion 724 of the aligned contact spring 720. Finally, the free end of each cantilever portion 824 has an identical bifurcated cam follower 860 molded thereto that extends toward the associated actuator 400 and straddles the cam follower 760 on the cantilever portion 724 of the aligned contact spring 720.

It is seen from the lines drawn from the cam followers 760 and 860 to the cam surfaces 480 on the body portion 410 of the associated actuator 400 that the cam followers on each aligned pair of contact springs 720 and 820 interacts with an individual group of cam surfaces. When the actuator 400 is in its upward position, which is the position shown in FIG. 4, the cam followers 760 and 860 on the cantilever portions 724 and 824 of the right-most pair of contact springs 720 and 820 engage a common vertical cam surface 481. The configuration of the cam followers 760 is such that in this position the cantilever portion 724 is deflected from its unstressed position a distance sufficient to generate the spring force necessary to assure engagement of the cam follower with the cam surface. In addition, the configuration of the cam follower 860 is such that when it and the cam follower 760 are in engagement with a common cam surface, the cantilever portion 824 is deflected a distance sufficient to provide a preselected separation between its contact 850 and the contact 750 on the contact spring 720.

When the actuator 400 is moved downward, the cam follower 860 moves from the vertical cam surface 481 to a rearwardly inclined cam surface 482. The cantilever portion 824 of the contact spring 820 is thereby permitted to move rearward and the configuration of the cam surface 482 is such that the contact spring 820 moves its contact 850 into engagement with the mating contact 750 on the cantilever portion 724 of the contact spring 720 before the cam follower 860 reaches the upper-most end of the cam surface 482. Thus as the downward movement of the actuator 400 continues, the rearward movement of the cantilever portion 824 is arrested by the engagement of the contacts 750 and 850, and the cam surface 482 separates from the cam follower 860. In this position of the cantilever portion 824 it is deflected from its unstressed position a distance sufficient to provide at least the minimum contact force necessary to provide a low resistance path between the contact springs. Thereafter, the cam follower 760 moves into engagement with the forwardly inclined cam surface 483, and both cantilever portions 724 and 824 are deflected forwardly. This forward deflection results in an increase in contact force above the above-noted minimum and in relative movement between the contact springs 720 and 820 to provide a wiping of the engaging surfaces of the contacts 750 and 850.

It is seen that the cam surfaces 480 engaged by the cam followers 760 and 860 on the left-most pair of contact springs 720 and 820 are basically the same as the ones just described. The only difference is that the surface equivalent to the cam surface 482 is displaced upwardly. Thus, the right-most and left-most contact spring pairs 720 and 820 both provide normally open switches, but the right-most contact spring pair closes before the left-most contact spring pair. The cam surfaces 480 engaged by the cam followers 760 and 860 of the middle pair of contact springs 720 and 820 are, on the other hand, the inverse of the ones just described. The middle pair of contact springs 720 and 820 are therefore normally closed and its associated cam surfaces 480 are arranged so that it opens after the right-most pair of contact springs close and before the left-most pair of contact springs close. Consequently, by strapping together the terminals 722 of the right-most and middle contact springs 720, a make before break transfer sequence is provided, and by strapping together the terminals of the middle and left-most contact springs 720 a break before make transfer sequence is provided.

Figure 5:
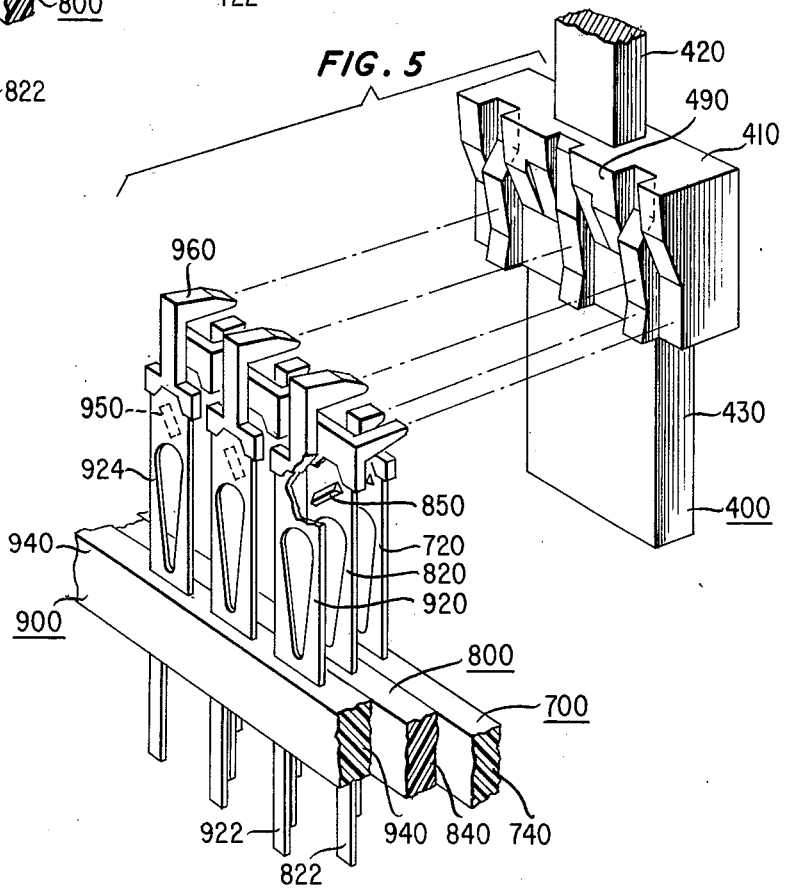
FIG. 5 is an exploded perspective view showing the addition of a third contact spring assembly to the contact spring assemblies of FIG. 4 and showing cam surfaces on the actuator adapted for interacting with three contact spring pileups.
Figure 8:
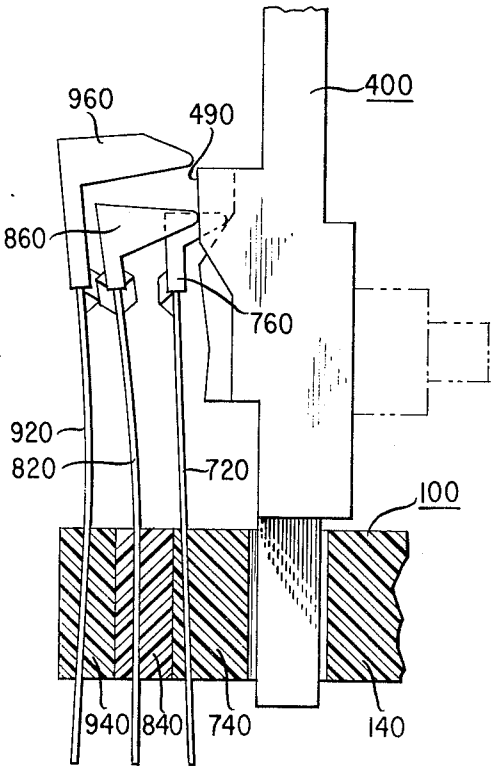
FIGS. 6 through 8 are enlarged sectional views showing the sequential interaction between the three contact spring pileup and associated cam surfaces configured to provide a make before break transfer switch.
Figure 7:
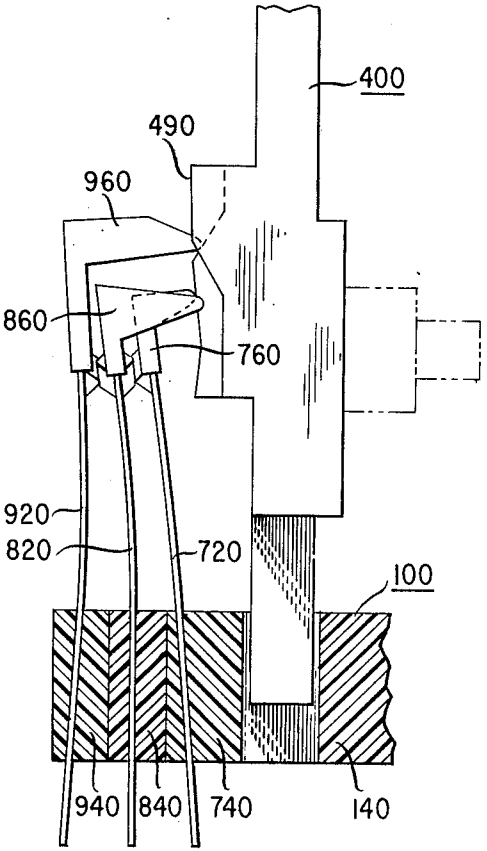
Figure 6:
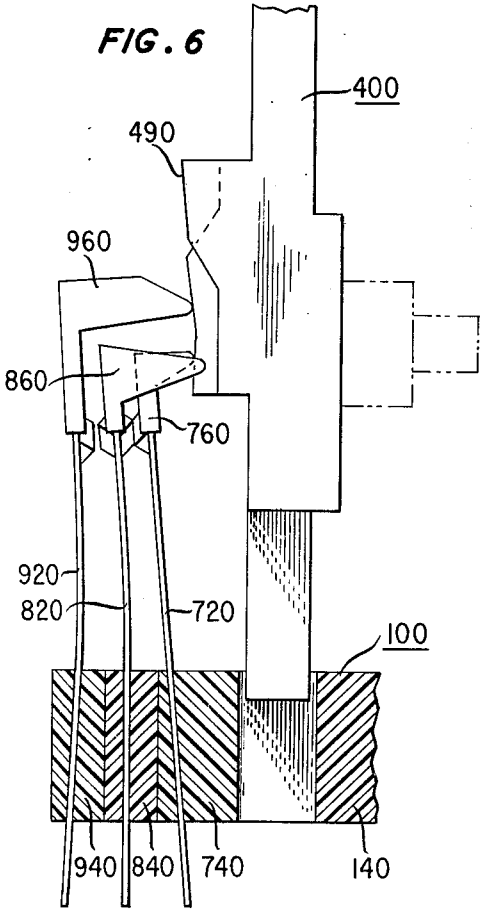

However, if more than one transfer sequence is necessary responsive to the movement of the actuator 400, then as shown in FIG. 5, contacts 850 are bonded to both surfaces of the cantilever portions 824 of the contact springs 820 and a third contact spring assembly 900 is provided. The contact spring assembly 900 is similar to the contact spring assemblies 700 and 800 in that it includes a multiplicity of contact springs 920 having a common mounting element 940 molded thereon in the proximity of the lower end thereof. The mounting element 940 locates the contact springs 920 side by side in a common plane with the same spacing as the contact springs 720 and 820. Furthermore, the mounting element 940 is positioned in direct engagement with the mounting element 840 and has a plurality of pins (not shown) that are respectively accommodated in conforming cavities (not shown) in the mounting element 840 to accurately locate the mounting element 940 with respect to the mounting element 840. The contact springs 920 are thereby accurately located both laterally, vertically, and at a particular angle with respect to the actuators 400 and the contact springs 720 and 820. The mounting element 940 locates the contact springs 920 in alignment with the contact springs 720 and 820 and, as shown in FIGS. 6–10, in a plane that extends obliquely with respect to the path of movement of the actuators 400, the upper ends of the contact springs extending toward the actuators.

Figure 11:
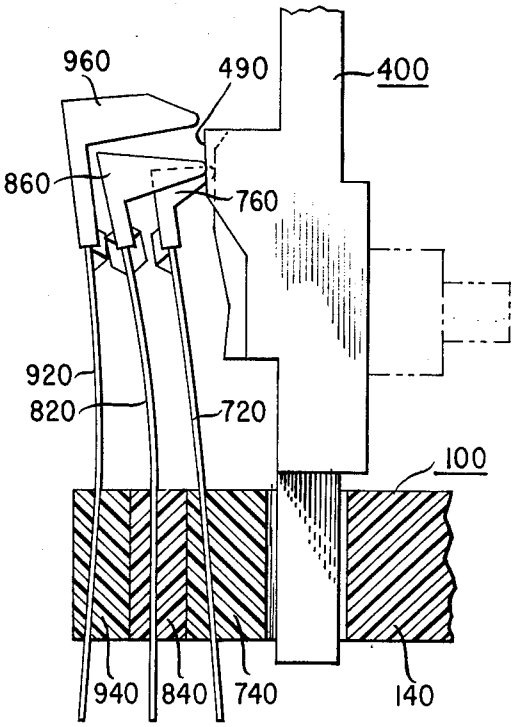
FIGS. 9 through 11 are enlarged sectional views showing the sequential interaction between the three contact spring pileup and associated cam surfaces configured to provide a break before make transfer switch.
Figure 10:
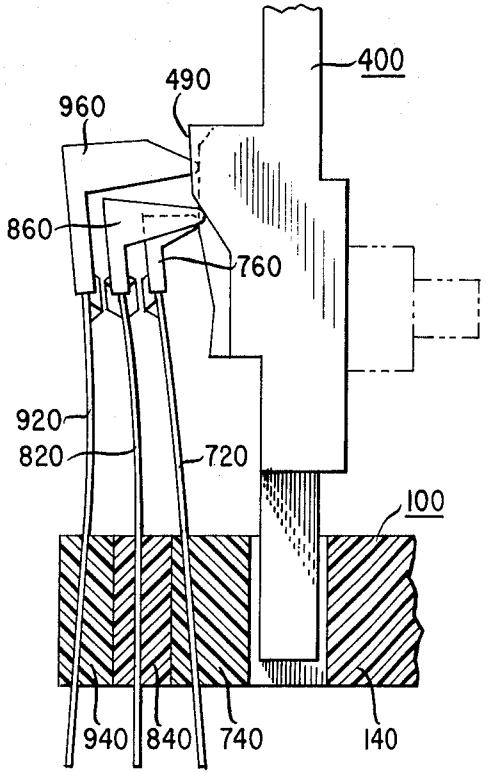
Figure 9:
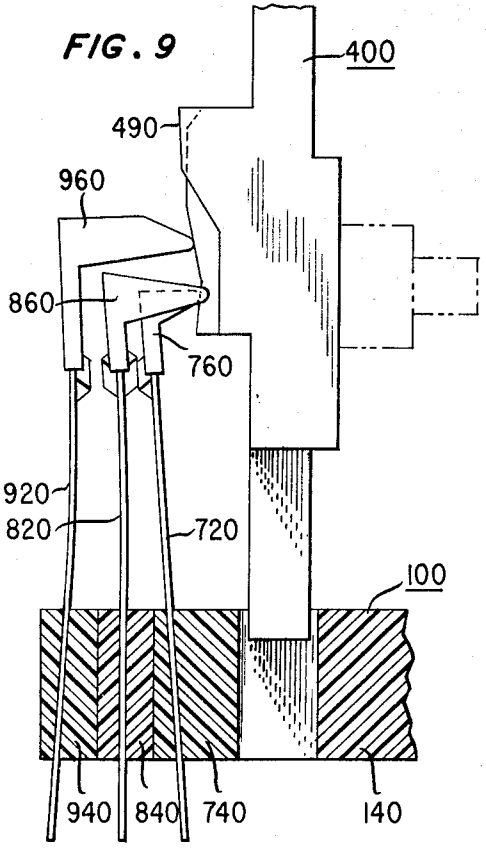

Each contact spring 920 includes a depending terminal 922 that is offset opposite to the terminals 822 of the contact springs 820. In addition, each contact spring 920 includes an upstanding cantilever portion 924 having a precious metal contact 950 bonded thereto on the surface facing and in a position to engage the opposing contacts 850 on the cantilever portion 824 of the aligned contact spring 820. Finally, the free end of each cantilever portion 924 has an identical cam follower 960 molded thereon that extends toward the associated actuator 400 and is positioned above, is approximately the same width as, and is aligned with the cam follower 760 on the aligned contact spring 720. Although as a result of the foregoing relationship it would appear that the cam followers 960 on the contact springs 920 engage essentially the same cam surfaces 490 on the actuator 400, it is seen from FIGS. 6–8 that these cam surfaces can be arranged to provide a make before break switching sequence or, as shown in FIGS. 9–11, a break before make switching sequence. The cam surfaces 490 on the actuator 400 shown in FIG. 5 are arranged such that the right-most and left-most groups of contact springs 720, 820 and 920 both provide the make before break switching sequence, while the middle group of contact springs provides the break before make switching sequence.

Returning now to FIG. 1, it is seen that the disclosed multibutton key incorporates a dummy mounting element 940' when the third contact spring assembly is not included. In addition, it is seen that the securing of the contact springs 700 and 800 to the frame 100 provides an operative multibutton key. A plurality of fasteners 10, one of which is shown, are threaded through the mounting elements 940', 840 and 740 and into the lower locating element 140 of the frame 100 to achieve this result.

If signaling lamps are to be included in the key, a unitary lamp support 1000 is also fastened to the frame 100. The support 1000 includes a plurality of fingers 1010 that are equal in number to and have a size and spacing to extend within each of the notches 124 in the upper locating element 120 of the frame 100. The fingers 1010 provide bearing surfaces for the upper guide portions 420 of the actuators 400, and each finger includes an upstanding boss (not shown) that like the bosses 125 on the upper locating element 120 is embraced by the lower end of the associated spring 600.

The support 1000 also includes a plurality of lamp chambers 1020 respectively situated adjacent to the buttons 500 on the actuators 400. Each chamber 1020 is adapted to accommodate an individual light emitting diode (not shown), and the upper end of each chamber is closed by a lens 1030. The leads of the light emitting diodes extend downwardly from the underside of the chambers and are advantageously electrically connected to a printed circuit board 1100 secured to standoffs on the support 1000.

Although only a few specific exemplary embodiments of this invention have been described in detail, those in the art will appreciate that many variations and/or modifications may be made in the exemplary embodiments without in any way departing from the novel and advantageous features of this invention. Accordingly, all such variations and modifications are intended to be included within the scope of this invention as defined in the appended claims.

What is claimed is:

1. A switch comprising: a movable actuator having a body portion on which a plurality of cam surfaces are located, and a pair of aligned guide portions that extend oppositely from the body portion;

a frame for supporting the actuator comprising a rigid metal channel having an upper and a lower element respectively molded to the extremities thereof, the upper and lower element each including a notch, the notches being aligned with one another and accommodating the guide portions of the actuator and cooperating with the guide portions to direct the movement of the actuator; and a first and second contact spring positioned adjacent to one another, each contact spring being associated with an individual cam surface of the actuator and at least one contact spring being deflected responsive to the movement of the actuator, each contact spring being associated with a cam follower in the proximity of one end thereof that extends into juxtaposition with the associated cam surface of the actuator and each contact spring having a mounting element molded thereon in the proximity of the other end thereof, the mounting elements of the contact springs being positioned in engagement with one another and secured to the frame and serving to orient the contact springs at a particular angle with respect to one another and with respect to the cam surfaces of the actuator, and the cam followers in combination with the associated cam surfaces serving to locate and provide a predetermined bias to the contact springs.

2. A switch as in claim 1 wherein the movement of the actuator is limited by the engagement of the body portion with the upper and lower elements of the frame.

3. A switch as in claim 1 wherein the actuator further includes an integral catch portion extending from the end of the upper guide portion for securing a button to the actuator, the catch portion comprising a pair of inverted L-shaped flexible elements having upwardly extending legs terminated by laterally and oppositely extending feet, the legs being positioned within an opening in the button and the feet engaging an upper surface of the button with the underside of the button in engagement with the upper guide portion.

4. A switch as in claim 3 wherein the feet of the flexible elements extend within a recess in the top of the button and the upper guide portion seats within a conforming recess in the underside of the button.

5. A switch as in claim 3 wherein the button comprises an inverted cup-shaped member having a depending cylindrical portion in the center thereof through which the opening extends, the upper end of a helical compression spring extends within the button and encompasses the cylindrical portion, and the lower end of the spring embraces a plurality of bosses protruding from the top surface of the upper locating element of the frame, the spring biasing the actuator upwardly.

6. A switch as in claim 1 wherein three side by side pairs of first and second contact springs interact with the cam surfaces of the actuator, two of the pairs of the contact springs being normally open and one of the pairs of contact springs being normally closed, the movement of the actuator resulting in a first pair of normally open contact springs closing before the second pair of normally open contact springs and the normally closed pair of contact springs opening after the closing of the first pair of normally open contact springs and before the closing of the second pair of normally open contact springs.

7. A switch as in claim 6 wherein one of the contact springs of the first pair of normally open contact springs is electrically connected to one of the contact springs of the pair of normally closed contact springs to provide a make-before-break transfer switch.

8. A switch as in claim 6 wherein one of the contact springs of the second pair of normally open contact springs is electrically connected to one of the contact springs of the pair of normally closed contact springs to provide a break-before-make transfer switch.

9. A switch as in claim 1 wherein the mounting elements of the first and second contact springs orient the contact springs so that they lie in intersecting planes.

10. A switch as in claim 1 wherein the mounting element of the first contact spring includes a protrusion that is accommodated within the notch in the lower element of the frame and provides a bearing surface for the lower guide portion of the actuator.

11. A switch as in claim 1 further including a lamp support secured to the frame, the lamp support including a finger that extends within the notch in the upper element of the frame and provides a bearing surface for the upper guide portion of the actuator.

12. A switch as in claim 11 wherein the lamp support includes a lamp chamber situated adjacent to the actuator.

13. A switch as in claim 12 wherein leads of a lamp accommodated by the lamp chamber are electrically connected to a circuit board secured to the lamp support.

* * * * *